US010164346B2

(12) United States Patent
Ming et al.

(10) Patent No.: US 10,164,346 B2
(45) Date of Patent: Dec. 25, 2018

(54) MULTIPLE-INPUT MULTIPLE-OUTPUT (MIMO) OMNIDIRECTIONAL ANTENNA

(71) Applicant: ALPHA WIRELESS LIMITED, Portlaoise, County Laois (IE)

(72) Inventors: Cao Ming, County Laois (IE); Fergal Lawlor, County Laois (IE)

(73) Assignee: ALPHA WIRELESS LIMITED (IE)

( * ) Notice: Subject to any disclaimer, the term of this patent is extended or adjusted under 35 U.S.C. 154(b) by 0 days.

(21) Appl. No.: 15/436,941

(22) Filed: Feb. 20, 2017

(65) Prior Publication Data

US 2017/0244176 A1 Aug. 24, 2017

(30) Foreign Application Priority Data

Feb. 18, 2016 (GB) ..... 1602840.9

(51) Int. Cl.

| | |
|---|---|
| ***H01Q 21/26*** | (2006.01) |
| ***H01Q 1/24*** | (2006.01) |
| ***H01Q 1/42*** | (2006.01) |
| ***H01Q 21/00*** | (2006.01) |
| ***H01Q 21/20*** | (2006.01) |

(52) U.S. Cl.
CPC ..... *H01Q 21/26* (2013.01); *H01Q 1/246* (2013.01); *H01Q 1/42* (2013.01); *H01Q 21/00* (2013.01); *H01Q 21/205* (2013.01)

(58) Field of Classification Search
CPC ..... H01Q 21/205; H01Q 21/26
See application file for complete search history.

(56) References Cited

U.S. PATENT DOCUMENTS

| | | | |
|---|---|---|---|
| 5,923,296 | A | 7/1999 | Sanzgiri et al. |
| 8,063,832 | B1 | 11/2011 | Weller et al. |
| 2010/0119002 | A1 | 5/2010 | Hartenstein |
| 2013/0265197 | A1 | 10/2013 | Jones |

FOREIGN PATENT DOCUMENTS

| | | | |
|---|---|---|---|
| CN | 2729936 | Y | 9/2005 |
| JP | H0832347 | A | 2/1996 |
| JP | 2015233194 | A | 12/2015 |
| WO | 2008156429 | A1 | 12/2008 |
| WO | 2011120090 | A1 | 10/2011 |
| WO | 2015190675 | A1 | 12/2015 |

*Primary Examiner* — Graham Smith
(74) *Attorney, Agent, or Firm* — Renner Kenner Greive Bobak Taylor & Weber

(57) ABSTRACT

The present invention relates to a Multiple-Input Multiple-Output (MIMO) omnidirectional antenna comprising three or more column sets arranged in a centrosymmetricly. Each column set comprises two or more antenna columns, each having a plurality of radiators mounted thereon. Each antenna column receives no more than two signals to be transmitted, and is arranged axisymmetricly about a radially-directed axis created between the center point of the antenna and a transverse cross-sectional midpoint on the antenna column. Therefore, each radiation pattern established by each of the three or more column sets is centrosymmetric about the center point of the antenna and axisymmetric about the radially-directed axis. The MIMO omnidirectional antenna can fit within a radome of small diameter, while providing relatively uniform radiation plot coverage across a microcell where it is deployed. As no phase shifting is utilized, there is little ripple effect and all of the ports have a similar gain.

20 Claims, 7 Drawing Sheets

MULTIPLE-INPUT MULTIPLE-OUTPUT (MIMO) OMNIDIRECTIONAL ANTENNA

FIELD OF THE INVENTION

This present invention relates to a particular design of a Multiple-Input Multiple-Output (MIMO) omnidirectional antenna. The present invention is further directed towards a first example of such a design which realises a 4×4 MIMO omnidirectional antenna, and a second example of such a design which realises an 8×8 MIMO omnidirectional antenna. Alternative variants of higher order MIMO omnidirectional antennas also fit with the design of the present invention and all are considered to be within the scope of the present invention.

BACKGROUND OF THE INVENTION

Throughout the following specification, reference to a "column set" shall be understood to refer to two or more columns which act to form a section of radiation coverage over a portion of the 360° coverage area covered by the omnidirectional antenna. For example, if an omnidirectional antenna comprises three columns sets, then the antenna columns in each of the three column sets will act to cover approximately 120° of the 360° coverage area. On the other hand, if there are six column sets, then the antenna columns in each of the six columns sets will act to cover substantially 60° of the 360° coverage area of the omnidirectional antenna.

Throughout the following specification, reference to an "antenna column" shall be understood to refer to an outwardly facing component of the antenna which will mount one or more antenna radiator elements which directs the beam of radiation from the radiators.

Throughout the following specification, reference to a "radiator", an "antenna radiator", a "radiator element", a "radiation element", and/or an "antenna radiation element" shall be understood to refer to the component of the antenna which transmits/radiates the antenna beam.

At present, 2×2 MIMO omnidirectional antennas are used to transmit approximately double the amount of data over a radio frequency channel compared to a single, typical antenna arrangement. The 2×2 MIMO omnidirectional antenna arrangement achieves this doubling of throughput by using two antennas, co-located on the transmitter side, and, two antennas co-located on the receiver side. 2×2 MIMO omnidirectional antennas are deployed in the real world at present and have achieved great commercial success.

For the 2×2 MIMO omnidirectional antenna, a three- or four-sided design may be used. The three-sided type of design is shown in FIG. 1*a* and FIG. 1*b* shows the type of radiation pattern which this three-sided 2×2 MIMO omnidirectional antenna produces. The three-sided 2×2 MIMO omnidirectional antenna comprises three antenna columns 102A, 102B, 102C which each have a plurality of radiators mounted thereto and are housed within a radome 106. The 2×2 MIMO omnidirectional antenna is popular for microcell deployments, where a low power base station is used to form the microcell in a mobile phone network. The coverage afforded by the low power base station in the microcell is determined by using power control so as to limit the range of the microcell's coverage area. Depending on the frequency range being used, the typical range of a microcell is a few hundred meters and is usually less than two kilometers wide, whereas standard base stations deployed on a macrocell may have ranges of up to 40 kilometers. Referring to FIG. 1*b* and the radiation plot 108, it can be seen that the level of ripple, which is defined by the range of signal loss in dB between the strongest signal 110 and the weakest signal 112, is relatively small (approx. 1.5 dB) and is considered to be more than acceptable.

The 2×2 MIMO omnidirectional antenna typically consist of +/−45° polarisations or H&V polarisations. The +/−45° omnidirectional antennas are often referred to as a Pseudo Omni, or Quasi Omni, as they do not have a perfect omnidirectional pattern, which would be substantially circular in nature when viewed on a radiation polar plot. As can be seen in FIG. 1*b*, ripple is present on a 2×2 MIMO omnidirectional antenna pattern and this ripple causes deviation from a perfectly circular pattern. The amount of ripple can vary depending on which antenna manufacturer constructed the antenna and the construction techniques they used. In general, a +/−1.5 dB ripple would be considered to be very good and this level of ripple is shown in FIG. 1*b;* +/−3.0 dB ripple would be deemed to be acceptable and higher levels of ripple are not acceptable as issues will arise with coverage throughout the microcell.

As mentioned above, 2×2 MIMO omnidirectional antennas with very good or acceptable levels of ripple are commercially deployed and popular for microcells as the antenna design allows for a relatively compact antenna to fit within a radome, which is a tubular cover for the antenna, having a relatively small diameter.

Focus has now turned to 4×4 MIMO omnidirectional antennas in order to achieve a further approximate doubling of throughput again.

The development and popularity of microcells, particularly in built up urban areas, requires relatively small antennas which will not be an eyesore when installed on a side of a building or on a street lamp or power line post. Thus, it is desirable to use an antenna design which is ultra-compact yet delivers good and relatively uniform coverage across the cell by having low levels of ripple.

A commercially deployed solution for providing a 4×4 MIMO omnidirectional antenna has been to provide two 2×2 MIMO omnidirectional antennas in a physically separated arrangement. This arrangement is shown in FIG. 2*a*. The 4×4 MIMO omnidirectional antenna 200 of the prior art comprises two 2×2 MIMO omnidirectional antennas 100 as are known in the prior art and which are physically separated by a predefined distance 202. This predefined distance 202 is usually 10 times the wavelength (A) of the transmission wave. This arrangement is easy to deploy but is undesirable as the overall size of the arrangement is relatively large and is widely considered to be an eyesore, particularly in urban environments.

An alternative is to use two 2×2 MIMO omnidirectional antennas which are stacked. This arrangement is shown in FIG. 2*b*. The 4×4 MIMO omnidirectional antenna 204 of the prior art comprises two 2×2 MIMO omnidirectional antennas 100A, 100B as are known in the prior art and which are stacked within the radome 205. This retains a relatively small radome 205 diameter, however the height of the radome 205 is doubled. Aside from the increase in height of the radome 205 which is undesirable, there are also issues with a loss of signal strength as the signal for the upper 2×2 MIMO omnidirectional antenna 100B needs to be delivered approximately one meter higher than the signal for the lower 2×2 MIMO omnidirectional antenna 100A. This extra cabling length results in approximately 0.5 dB loss in signal strength. Yet a further issue with the 'stacked' design approach is that the upper and lower 2×2 MIMO omnidirectional antennas 100A, 100B will have slightly different radiation polar plot patterns due to manufacturing tolerances and so on. Therefore, the coverage across the cell is not entirely uniform for each of the four ports in the stacked 4×4 MIMO omnidirectional antenna arrangement.

It has been shown that the benefits of MIMO, when using vertically stacked antenna arrays, is less than that given when the antenna arrays are deployed in a side-by-side fashion. In particular, the side-by-side antenna array shows increased data throughput and the side-by-side antenna array therefore provides higher capacity than the vertically stacked antenna arrays. Instead of stacking two 2×2 MIMO omnidirectional antennas, it has therefore been proposed to provide two 2×2 MIMO omnidirectional antenna in a side-by-side arrangement. This is shown in FIG. 2*c*. The 4×4 MIMO omnidirectional antenna 206 of the prior art comprises six antenna columns 210A, 210B, 210C, 210D, 210E, 210F with pairs of antenna columns 210A/210B, 210C/210D, 210E/210F arranged side-by-side to form a three-sided omnidirectional antenna housed within a radome 208. Each of the pairs of antenna columns 210A/210B, 210C/210D, 210E/210F arranged side-by-side form one of three column sets. The diameter of the radome 208 for the side-by-side approach is quite large and this is unwelcome. Moreover, the side-by-side arrangement of the radiators on the antenna columns 210A-F causes a larger ripple effect of the radiation pattern which can exceed +/−5.0 dB as is seen from FIG. 2*d*. The radiation plot 212 in FIG. 2*d* shows some acceptable signal strength 214 in some directions, but effectively null areas 216 in other directions. This is beyond the acceptable levels of ripple for microcell coverage and therefore, the 4×4 MIMO omnidirectional antennas 206 using the side-by-side arrangement are not foreseen to be tolerable for many real world deployments.

A further alternative is to utilise phase shifting to effect a 4×4 MIMO omnidirectional antenna. PCT Patent Application Number PCT/AU2011/000365 (ARGUS TECHNOLOGIES (AUSTRALIA) PTY LTD.) discloses the use of phase shifting input signals through a Butler matrix to provide a 4×4 MIMO omnidirectional antenna. In one embodiment, a six column antenna, which is arranged in a hexagonal shape, is disclosed. This hexagonally arranged set of columns each receives each of the four input signals, which have been phase shifted prior to radiation by a plurality of dual polarised antenna elements on each column. It is well known in the art that the use of such phase shifting techniques causes excessive ripple of a radiation plot and this will affect the omnidirectional nature of the antenna coverage. In the case of the hexagonally arranged six columns, each column receives each of the four input signals after the input signals have been passed through a pair of six-way Butler matrices. Such a technique will cause ripple of up to 20 dB. This can be seen from the radiation plot indicated generally by reference numeral 600, shown in FIG. 6.

It is a goal of the present invention to provide a method and/or apparatus that overcomes at least one of the above mentioned problems by providing a MIMO omnidirectional antenna which displays low, acceptable levels of ripple whilst maintaining a compact structure.

SUMMARY OF THE INVENTION

The present invention is directed to The present invention is directed to a Multiple-Input Multiple-Output (MIMO) omnidirectional antenna comprising three or more column sets, where the three or more column sets are arranged in a centrosymmetric arrangement about a centre point of the antenna; each column set comprising two or more antenna columns and each of the antenna columns mounting a plurality of radiators thereon; whereby, each antenna column receives no more than two signals to be transmitted, and, each of the antenna columns is arranged to be axisymmetric about a radially-directed axis which extends between the centre point of the antenna and a transverse cross-sectional midpoint on the antenna column; such that, each radiation pattern established by each of the three or more column sets is centrosymmetric about the centre point of the antenna, and, is also axisymmetric about the radially-directed axis.

The advantage of providing the MIMO omnidirectional antenna with antenna columns which are arranged to be axisymmetric about a radially-directed axis created between the centre point of the antenna and a transverse cross-sectional midpoint on the antenna column is that the radiation pattern generated and radiated will be substantially symmetrical (both centrosymmetric and axisymmetric) and this results in the radiation pattern overlap at the edges of each sector of the radiation pattern being relatively similar on both sides. This improves the ripple effect and increases the omnidirectional coverage area afforded by the antenna design. The columns sets are arranged to be symmetrical (centrosymmetric) and within the column sets, the antenna columns are also arranged to be symmetrical. This further symmetrical arrangement within an existing symmetrical arrangement provides the advantages of the present invention.

In a further embodiment, the Multiple-Input Multiple-Output (MIMO) omnidirectional antenna is directed to a 4×4 Multiple-Input Multiple-Output (MIMO) antenna comprising six antenna columns arranged in a hexagonal arrangement, and/or, a 8×8 Multiple-Input Multiple-Output (MIMO) antenna comprising twelve antenna columns arranged in a dodecagonal arrangement.

In a further embodiment, each radiation pattern established by each of the three or more column sets is both centrosymmetric and axisymmetric for both amplitude and phase.

In a further embodiment, the Multiple-Input Multiple-Output (MIMO) omnidirectional antenna comprises three column sets.

In a further embodiment, the Multiple-Input Multiple-Output (MIMO) omnidirectional antenna comprises three column sets, and each column set comprises two antenna columns.

In a further embodiment, the Multiple-Input Multiple-Output (MIMO) omnidirectional antenna comprises three column sets, and each column set comprises four antenna columns.

In a further embodiment, the Multiple-Input Multiple-Output (MIMO) omnidirectional antenna comprises six column sets.

In a further embodiment, the Multiple-Input Multiple-Output (MIMO) omnidirectional antenna comprises a 4×4 Multiple-Input Multiple-Output omnidirectional antenna comprising a plurality of radiators mounted on six antenna columns, with each of the six antenna columns mounting a plurality of radiators; each of the six antenna columns being substantially rectangular in shape such as to comprise side edges, a top edge and a bottom edge whereby the side edges are longer than the top and bottom edges; each of the six antenna columns being positioned adjacent to two of the remaining antenna columns along its side edges, such that the six antenna columns are arranged to have a substantially hexagonal transverse cross-section; wherein the 4×4 Multiple-Input Multiple-Output omnidirectional antenna comprises four antenna ports for receiving four signals to be transmitted; two of the four ports being connected to three of the six antenna columns and the other two ports being connected to the other three antenna columns; whereby, the antenna columns are configured such that an antenna column connected to two of the antenna ports is situated intermediate two adjacent antenna columns connected to the other two ports.

This is a hexagonally-arranged 4×4 MIMO version of the present omnidirectional antenna invention.

In a further embodiment, the Multiple-Input Multiple-Output (MIMO) omnidirectional antenna comprises a 8×8 Multiple-Input Multiple-Output omnidirectional antenna comprising a plurality of radiators mounted on twelve antenna columns, with each of the twelve antenna columns mounting a plurality of radiators; each of the twelve antenna columns being substantially rectangular in shape such as to comprise side edges, a top edge and a bottom edge whereby the side edges are longer than the top and bottom edges; each of the twelve antenna columns being positioned adjacent to two of the remaining antenna columns along its side edges, such that the twelve antenna columns are arranged to have a substantially dodecagonal transverse cross-section; wherein the 8×8 Multiple-Input Multiple-Output omnidirectional antenna comprises eight antenna ports for receiving eight signals to be transmitted; a first pair of the eight ports being connected to a first group of three of the twelve antenna columns; a second pair of the eight ports being connected to a second group of three of the twelve antenna columns; a third pair of the eight ports being connected to a third group of three of the twelve antenna columns; and a fourth pair of the eight ports being connected to a fourth group of three of the twelve antenna columns; whereby, the antenna columns are configured such that one of the antenna columns in the first group is situated adjacent one of the antenna columns in the second group; with said antenna column in the second group being situated adjacent one of the antenna columns in the third group; and said antenna column in the third group being situated adjacent one of the antenna columns in the fourth group.

This is a dodecagonally-arranged 8×8 MIMO version of the present omnidirectional antenna invention.

The present invention is further directed to a 4×4 Multiple-Input Multiple-Output omnidirectional antenna comprising a plurality of radiators mounted on six antenna columns, with each of the six antenna columns mounting a plurality of radiators; each of the six antenna columns being substantially rectangular in shape such as to comprise side edges, a top edge and a bottom edge whereby the side edges are longer than the top and bottom edges; each of the six antenna columns being positioned adjacent to two of the remaining antenna columns along its side edges, such that the six antenna columns are arranged to have a substantially hexagonal transverse cross-section; wherein the 4×4 Multiple-Input Multiple-Output omnidirectional antenna comprises four antenna ports for receiving four signals to be transmitted; two of the four ports being connected to three of the six antenna columns and the other two ports being connected to the other three antenna columns; whereby, the antenna columns are configured such that an antenna column connected to two of the antenna ports is situated intermediate two adjacent antenna columns connected to the other two ports.

The advantage of providing the columns making up the 4×4 MIMO omnidirectional antenna in a hexagonal arrangement is that the antenna can fit within a radome of relatively small diameter, whilst the radiation plot coverage provided by the 4×4 MIMO omnidirectional antenna will be uniform across a microcell where the 4×4 MIMO omnidirectional antenna is deployed, and all of the ports of the 4×4 MIMO omnidirectional antenna will have a substantially similar gain. As no phase shifting is required to transmit all of the four input signals using this technique of grouping the columns into three column sets (each column set comprising a pair of columns), the ripple on the radiation plot will be kept to acceptable levels.

In a further embodiment, each of the six antenna columns comprises four radiators. In a further embodiment, each of the six antenna columns comprises six radiators. In a further embodiment, each of the six antenna columns comprises eight radiators.

In a further embodiment, the radiators are mounted substantially vertically in a linear fashion along the length of the rectangular-shaped antenna columns.

In a further embodiment, the antenna operates as a dual band 2×2 Multiple-Input Multiple-Output omnidirectional antenna.

In a further embodiment, the 4×4 Multiple-Input Multiple-Output omnidirectional antenna is housed within a tubular shaped radome.

In a further embodiment, the 4×4 Multiple-Input Multiple-Output omnidirectional antenna operates in one or more of: the 4900 MHz to 6100 MHz frequency range, the 3300 MHz to 3800 MHz frequency range, the 2300 MHz to 3800 MHz frequency range, the 1710 MHz to 2690 MHz frequency range, and, the 689 MHz to 960 MHz frequency range.

The present invention is further directed to a 8×8 Multiple-Input Multiple-Output omnidirectional antenna comprising a 4×4 Multiple-Input Multiple-Output omnidirectional antenna as hereinbefore described stacked on top of a second 4×4 Multiple-Input Multiple-Output omnidirectional antenna as hereinbefore described.

In a further embodiment, the 4×4 Multiple-Input Multiple-Output omnidirectional antenna does not comprise any radiators which use vertical polarised antennas. Such antennas are known to have poor decorrelation between ports.

The present invention is further directed to a 8×8 Multiple-Input Multiple-Output omnidirectional antenna comprising a plurality of radiators mounted on twelve antenna columns, with each of the twelve antenna columns mounting a plurality of radiators; each of the twelve antenna columns being substantially rectangular in shape such as to comprise side edges, a top edge and a bottom edge whereby the side edges are longer than the top and bottom edges; each of the twelve antenna columns being positioned adjacent to two of the remaining antenna columns along its side edges, such that the twelve antenna columns are arranged to have a substantially dodecagonal transverse cross-section; wherein the 8×8 Multiple-Input Multiple-Output omnidirectional antenna comprises eight antenna ports for receiving eight signals to be transmitted; a first pair of the eight ports being connected to a first group of three of the twelve antenna columns; a second pair of the eight ports being connected to a second group of three of the twelve antenna columns; a third pair of the eight ports being connected to a third group of three of the twelve antenna columns; and a fourth pair of the eight ports being connected to a fourth group of three of the twelve antenna columns; whereby, the antenna columns are configured such that one of the antenna columns in the first group is situated adjacent one of the antenna columns in the second group; with said antenna column in the second group being situated adjacent one of the antenna columns in the third group; and said antenna column in the third group being situated adjacent one of the antenna columns in the fourth group.

In this manner, one antenna column from each of the groups is arranged side-by-side into a column set comprising four antenna columns. There are three such column sets, and the three column sets are arranged in the dodecagonal shape of the 8×8 MIMO omnidirectional antenna so as to be centrosymmetric about the centre point of the antenna, and to be axisymmetric about the radially-directed axis.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF THE INVENTION

It will be understood that the general concept of the present invention may be described in terms of the principles for the design of the innovative antenna having particular characteristics regarding the number of column sets, the number of antenna columns in each column set, the symmetry of the column sets, the symmetry of the antenna columns, the symmetry of the radiation plots from the column sets, and, the number of input signal connections delivered to each antenna column. The invention is described in more detail in respect of an example of a 4×4 MIMO omnidirectional antenna which follows the principles of the present invention and has a hexagonal arrangement, and, also an 8×8 MIMO omnidirectional antenna which follows the principles of the present invention and has a dodecagonal arrangement.

Figure 6:
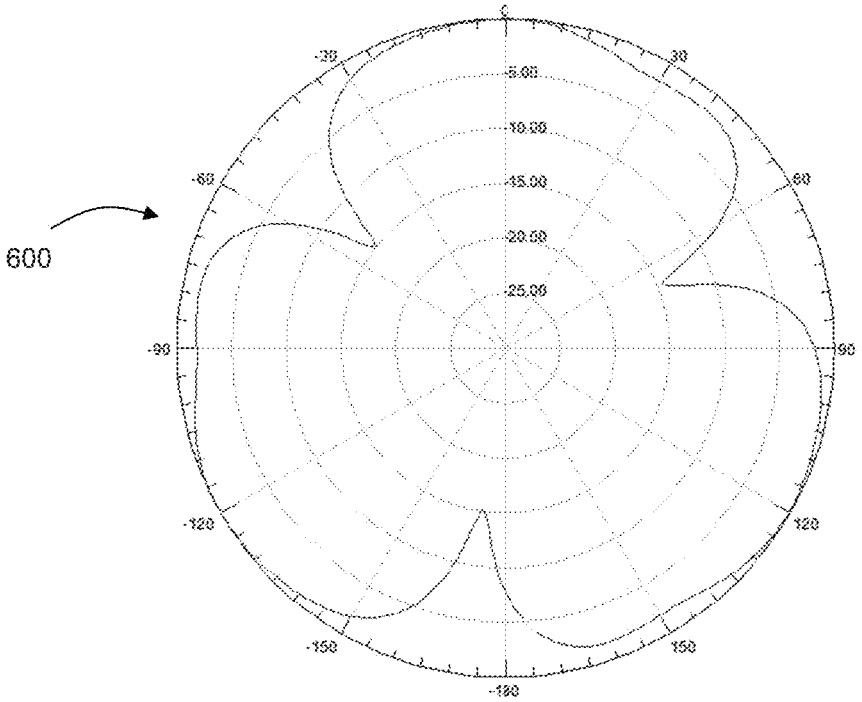
FIG. 6 is a polar radiation plot for a MIMO omnidirectional antenna of the prior art, which utilises Butler matrices for phase shifting signals to be transmitted.
Figure 7:
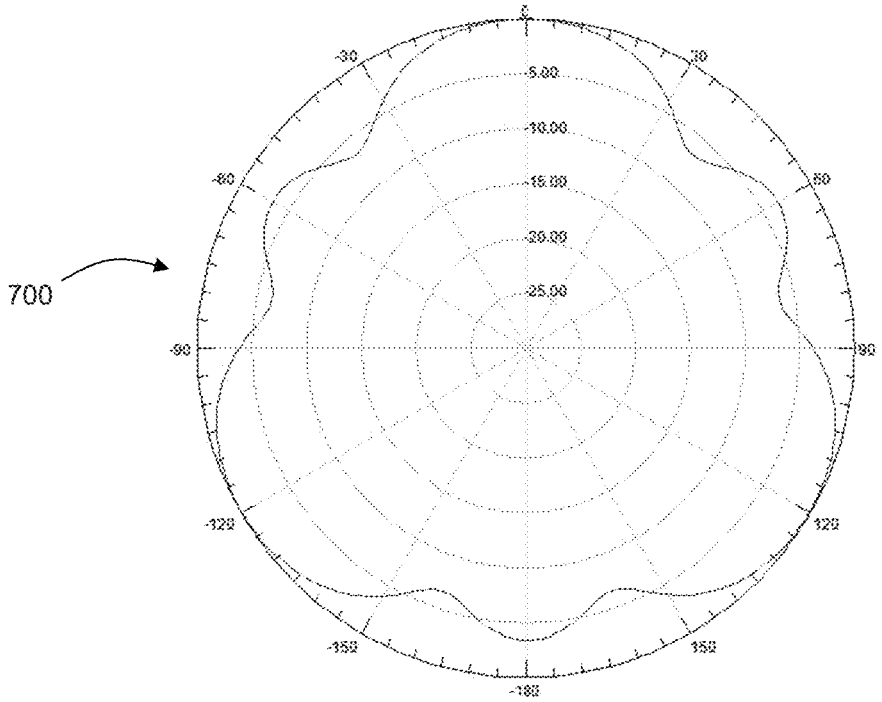
FIG. 7 is a polar radiation plot for the MIMO omnidirectional antenna of the present invention.

The general principle of the present invention can be described as a Multiple-Input Multiple-Output (MIMO) omnidirectional antenna comprising three or more column sets, where the three or more column sets are arranged in a centrosymmetric arrangement about a centre point of the antenna; each column set comprising two or more antenna columns and each of the antenna columns mounting a plurality of radiators thereon; whereby, each antenna column receives no more than two signals to be transmitted, and, each of the antenna columns is arranged to be axisymmetric about a radially-directed axis which extends between the centre point of the antenna and a transverse cross-sectional midpoint on the antenna column itself; such that, each radiation pattern established by each of the three or more column sets is centrosymmetric about the centre point of the antenna, and, is axisymmetric about the radially-directed axis. This is beneficial in comparison to other MIMO omnidirectional antennas known from the art, as this design of antenna provides better omnidirectional coverage over the microcell where the MIMO omnidirectional antenna is deployed. Referring to FIG. 7, such a radiation plot is shown and indicated generally by reference numeral 700, and, the improvement in coverage, when compared to the radiation plot of the prior art (FIG. 6), is clearly seen.

Figure 3:
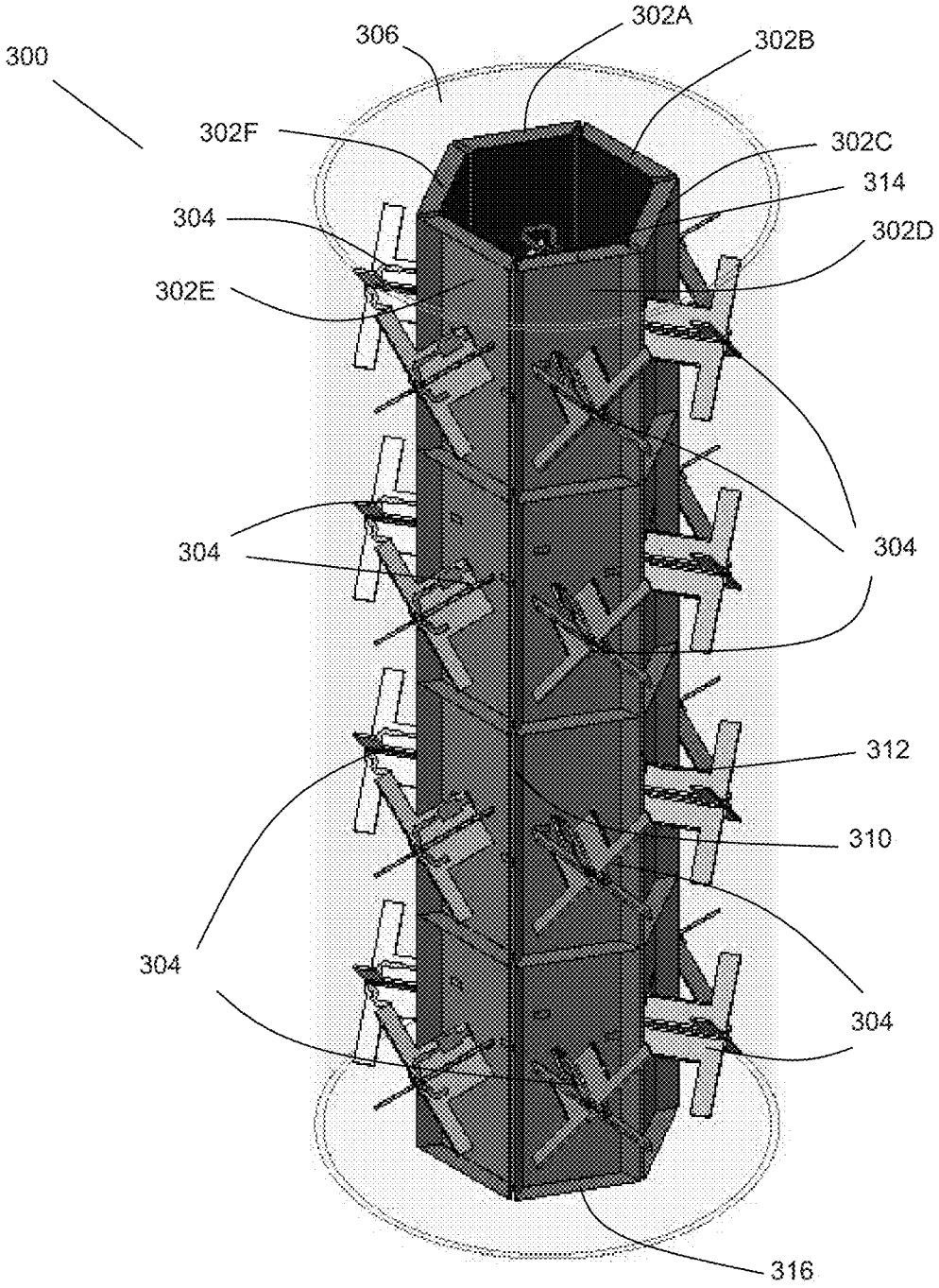
FIG. 3 is a perspective view of a 4×4 MIMO omnidirectional antenna, in accordance with the present invention.
Figure 4:
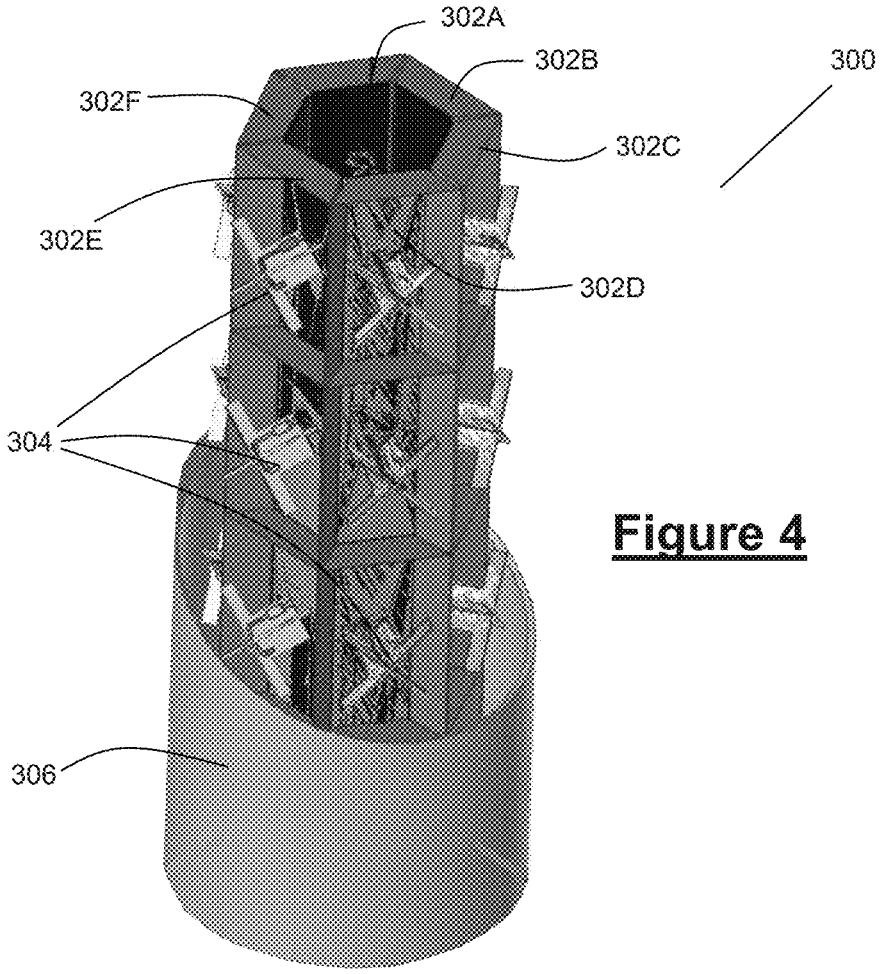
FIG. 4 is a perspective view of the 4×4 MIMO omnidirectional antenna of FIG. 3, partially encased by a radome in accordance with the present invention.

Looking at the 4×4 MIMO omnidirectional antenna example in particular detail, and referring to FIGS. 3 and 4, there is provided a 4×4 MIMO omnidirectional antenna indicated generally by reference numeral 300. The 4×4 MIMO omnidirectional antenna 300 comprises a six antenna columns 302A, 302B, 302C, 302D, 302E, 302F arranged in a substantially hexagonal arrangement such that the transverse cross-section of the antenna columns 302A-302F in the 4×4 MIMO omnidirectional antenna 300 will be substantially hexagonal in shape.

Each of the six antenna columns 302A, 302B, 302C, 302D, 302E, 302F is substantially rectangular in shape such as to comprise side edges 310, 312, a top edge 314 and a bottom edge 316 whereby the side edges 310, 312 are longer than the top edge 314 and the bottom edge 316.

The six antenna columns 302A-302F are each positioned adjacent to two of the remaining antenna columns along their side edges 310, 312, such that the six antenna columns 302A-302F are arranged to have a substantially hexagonal transverse cross-section. It is very important to arrange the six antenna columns 302A-302F in as tight a pattern as possible, for creating the smallest form factor possible, and also for improvements in the radiation pattern. It is not desirous to separate the six antenna columns 302A-302F away from one another and thus it is an aspect of the present invention that each of the six antenna columns 302A-302F are in abutment, along their side edges, with their two adjacent antenna columns 302A-302F. This encourages the transverse cross-sectional diameter of the 4×4 MIMO omnidirectional antenna 300 to be as small as possible.

Each of the six antenna columns 302A-302F has a plurality of radiators 304 mounted thereto. In a preferred embodiment as shown in FIG. 3, there are four radiators 304 mounted on each of the six antenna columns 302A-302F. The radiators 304 are mounted in a substantially vertical manner and in a linear fashion along the length of the rectangular-shaped antenna columns 302A-302F. These radiators 304 are dual polarised antenna elements which can radiate two signals at the same time by virtue of their dual polarisation.

A radome 306 encases the radiators 304 and the antenna columns 302A-302F. The relatively small diameter and height of the radome 306 is an important aspect of the present design as this will minimise the overall size of the antenna 300 and make it less of an eyesore when deployed in public spaces.

As a 4×4 MIMO omnidirectional antenna 300 will have four ports (not shown) to receive four signals to be sent using the 4×4 MIMO omnidirectional antenna 300, the signals on these four ports shall be connected to the radiators of the antenna columns 302A-302F. In a preferred embodiment, two of the four ports are connected to three of the six antenna columns 302A, 302C, 302E and the other two ports are connected to the other three antenna columns 302B, 302D, 302F of the 4×4 MIMO omnidirectional antenna 300. In this way, the antenna columns 302A-302F are configured such that an antenna column (e.g. 302A) connected to two of the antenna ports is situated intermediate two adjacent antenna columns (e.g. 302B and 302F) which are connected to the other two ports of the four ports of the 4×4 MIMO omnidirectional antenna 300. Three columns sets, with each column set comprising two antenna columns and each column set receiving all of the four input signals, are this established. The arrangement of the three column sets formed by the pairs of antenna columns 302A/302B, 302C/302D, 302E/302F is centrosymmetric about a central point of the 4×4 MIMO omnidirectional antenna 300, and each antenna column 302A-302F is axisymmetric about a radially-directed axis which extends between the centre point of the 4×4 MIMO omnidirectional antenna 300 and a transverse cross-sectional midpoint on the antenna column 302A-302F. The radiation pattern established by each of the three or more column sets is thus centrosymmetric about the centre point of the 4×4 MIMO omnidirectional antenna 300, and, is also axisymmetric about the radially-directed axis.

In preferred embodiments, the 4×4 MIMO omnidirectional antenna 300 of the present invention is intended to transmit over the 4900 MHz to 6100 MHz frequency range, the 3300 MHz to 3800 MHz frequency range, the 2300 MHz to 3800 MHz frequency range, the 1710 MHz to 2690 MHz frequency range, the 698 MHz to 960 MHz frequency range, and combinations of these mentioned frequency ranges.

A mechanism (not shown) to allow the 4×4 MIMO omnidirectional antenna 300 to act as a fixed tilt or a variable tilt omnidirectional antenna are envisaged to be employed in some embodiments of the invention.

Figure 1A:
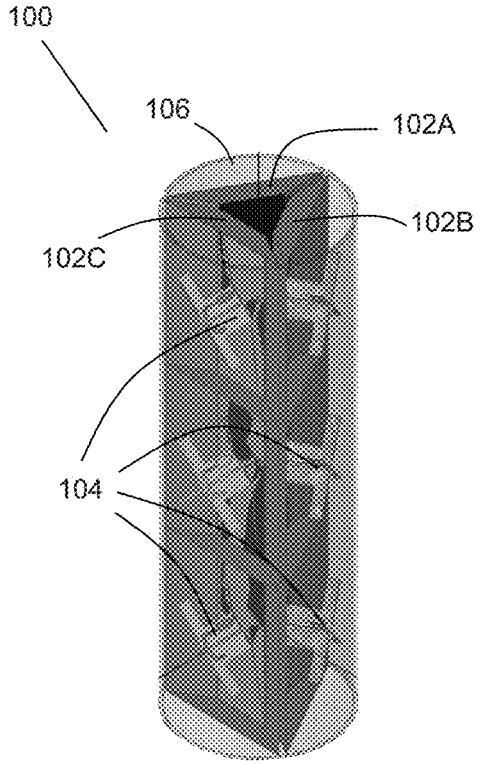
FIG. 1*a* is a perspective view of a 2×2 MIMO omnidirectional antenna of the prior art.
Figure 1B:
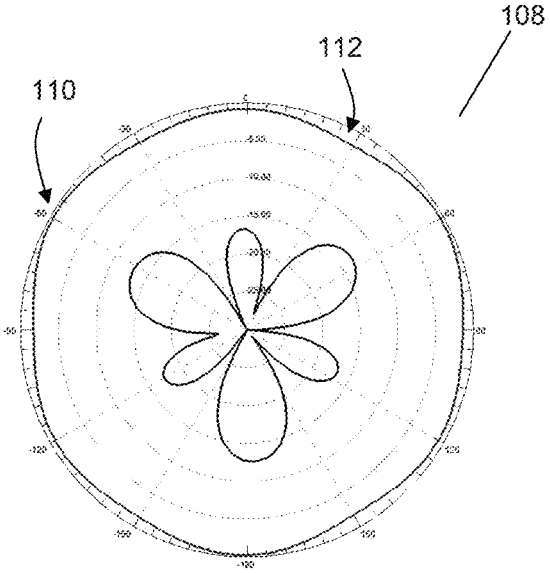
FIG. 1*b* is a polar radiation plot for the 2×2 MIMO omnidirectional antenna of FIG. 1*a;*
Figure 2A:
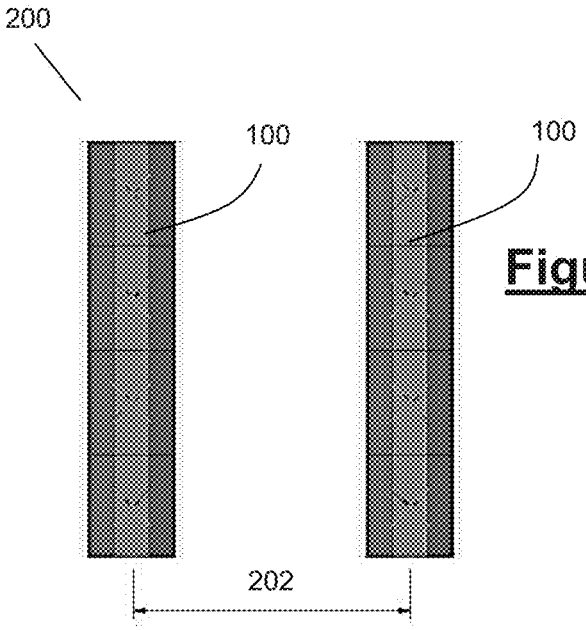
FIG. 2*a* is a perspective view of a 4×4 MIMO omnidirectional antenna of the prior art, formed by two, physically separated 2×2 MIMO omnidirectional antennas.
Figure 2B:
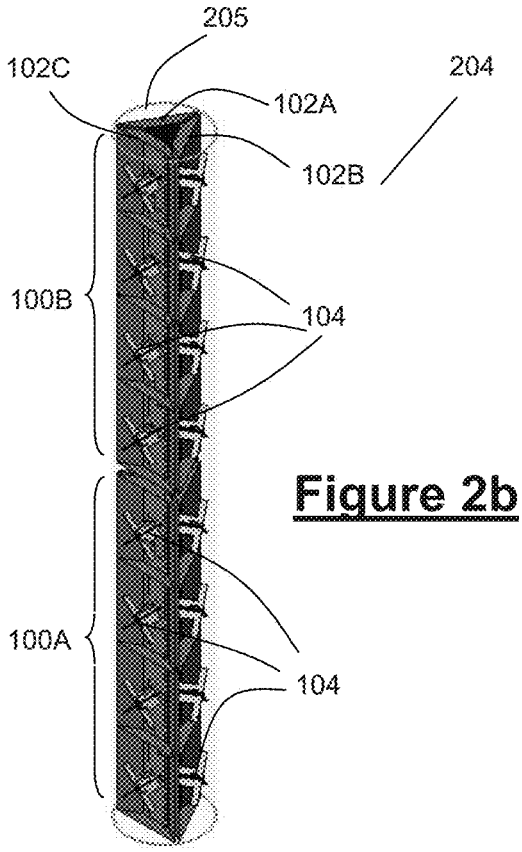
FIG. 2*b* is a perspective view of a 4×4 MIMO omnidirectional antenna of the prior art, formed by two, stacked 2×2 MIMO omnidirectional antennas.
Figure 2C:
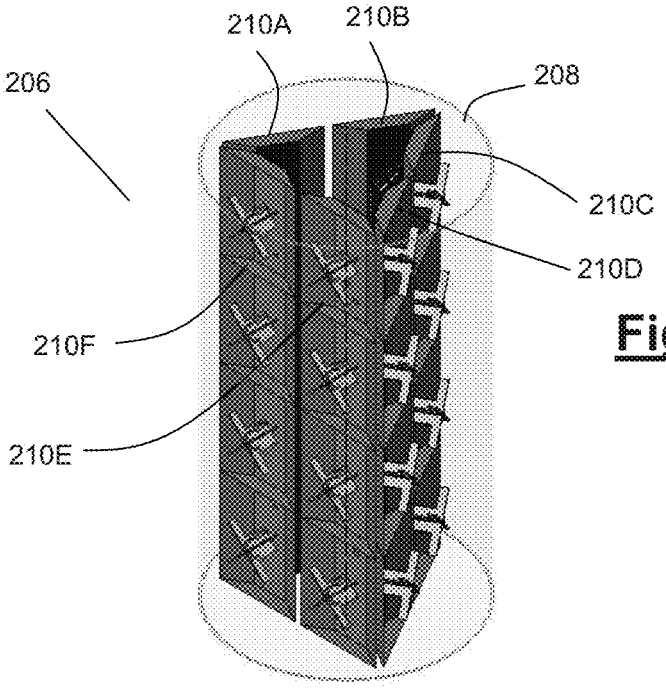
FIG. 2*c* is a perspective view of a 4×4 MIMO omnidirectional antenna of the prior art, formed by two, side-by-side 2×2 MIMO omnidirectional antennas.
Figure 2D:
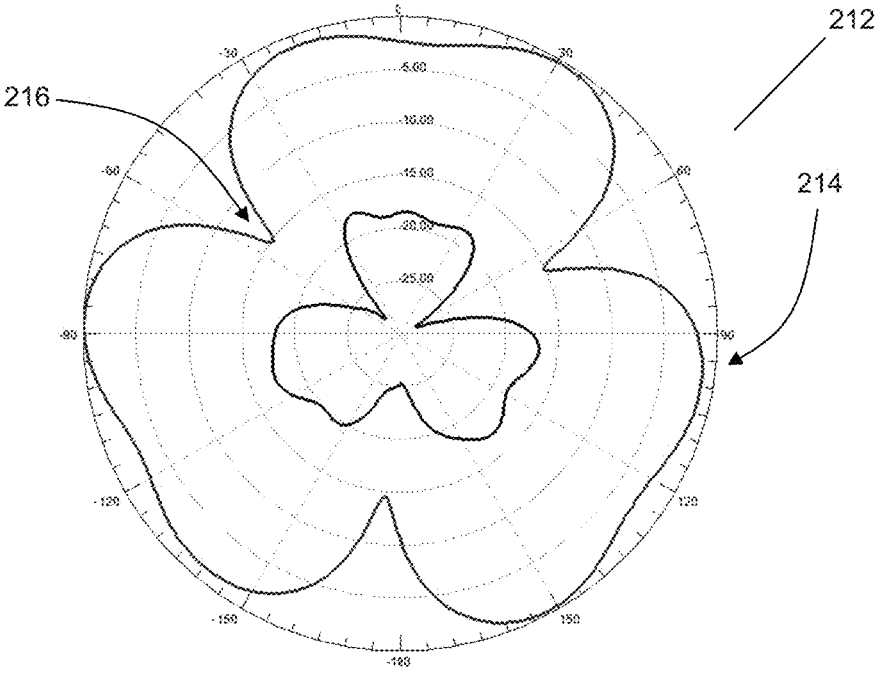
FIG. 2*d* is a polar radiation plot for the 4×4 MIMO omnidirectional antenna of FIG. 2*c;*

The advantages of the 4×4 MIMO omnidirectional antenna 300 of the present invention are that the 4×4 MIMO omnidirectional antenna 300 can be provided in a single radome 306 cover that is of a relatively small diameter. This allows for an ultra-compact design. The radome 306 as shown in FIG. 4 will have a smaller diameter than the radome 208 of FIG. 2*c*, and a shorter radome height than the radome 205 of FIG. 2*b*.

Figure 5:
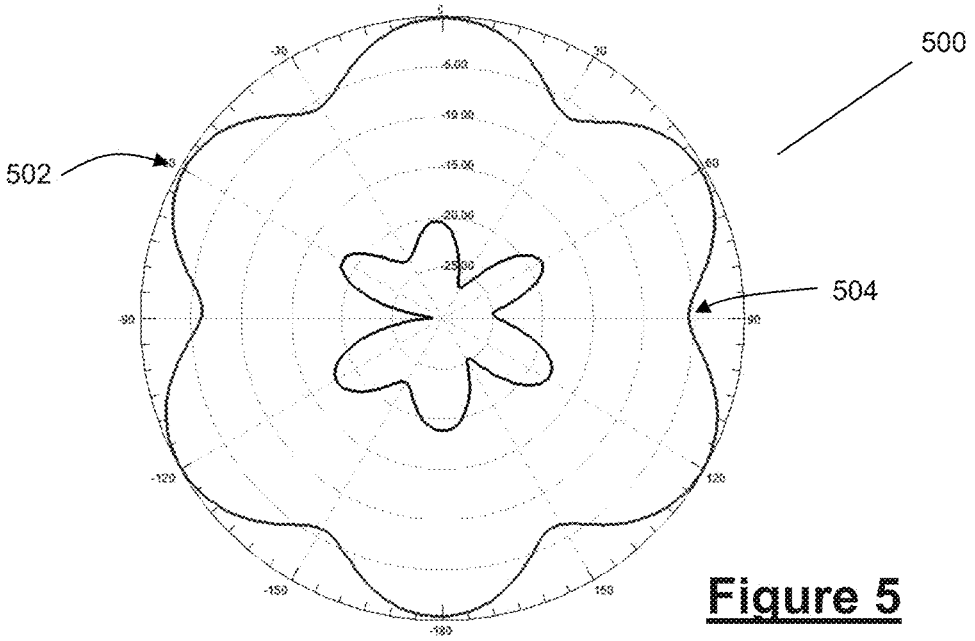
FIG. 5 is a polar radiation plot for the 4×4 MIMO omnidirectional antenna of FIG. 3.

There will be similar radiation plot patterns for each of the four ports as they are emitted using the same antenna radiators on the same horizontal plane. This is shown in FIG. 5, where the radiation plot 500 shows the ripple effect between the strongest signal directions 502 and the weaker signal directions 504 is acceptable.

As the cabling feeding the four ports will be the same length, there will be the same gains for each of the four ports also.

The radiators mounted on the antenna columns of the 4×4 MIMO omnidirectional antenna 300 of the present invention are separated by 60° from adjacent radiators on adjacent antenna columns as adjacent antenna columns are offset by 60° relative to each other such as to form the hexagonal shaped antenna 300. Therefore, the isolation between adjacent antenna columns is considered to be good when compared to the side-by-side configuration of the prior art, where the radiators are very close to each other and alternate adjacent antenna columns are on the same plane and not offset relative to each other.

The ripple effect is lessened when the centrosymmetric and axisymmetric requirements are met as the radiation pattern generated and radiated will be substantially symmetrical (both centrosymmetric and axisymmetric) and this results in the radiation pattern overlap at the edges of each sector of the radiation pattern being relatively similar on both sides. This improves the ripple effect and increases the omnidirectional coverage area afforded by the antenna design.

In other embodiments, the 4×4 MIMO omnidirectional antenna 300 of the present invention can be used as a dual band 2×2 MIMO omnidirectional antenna.

Figure 8:
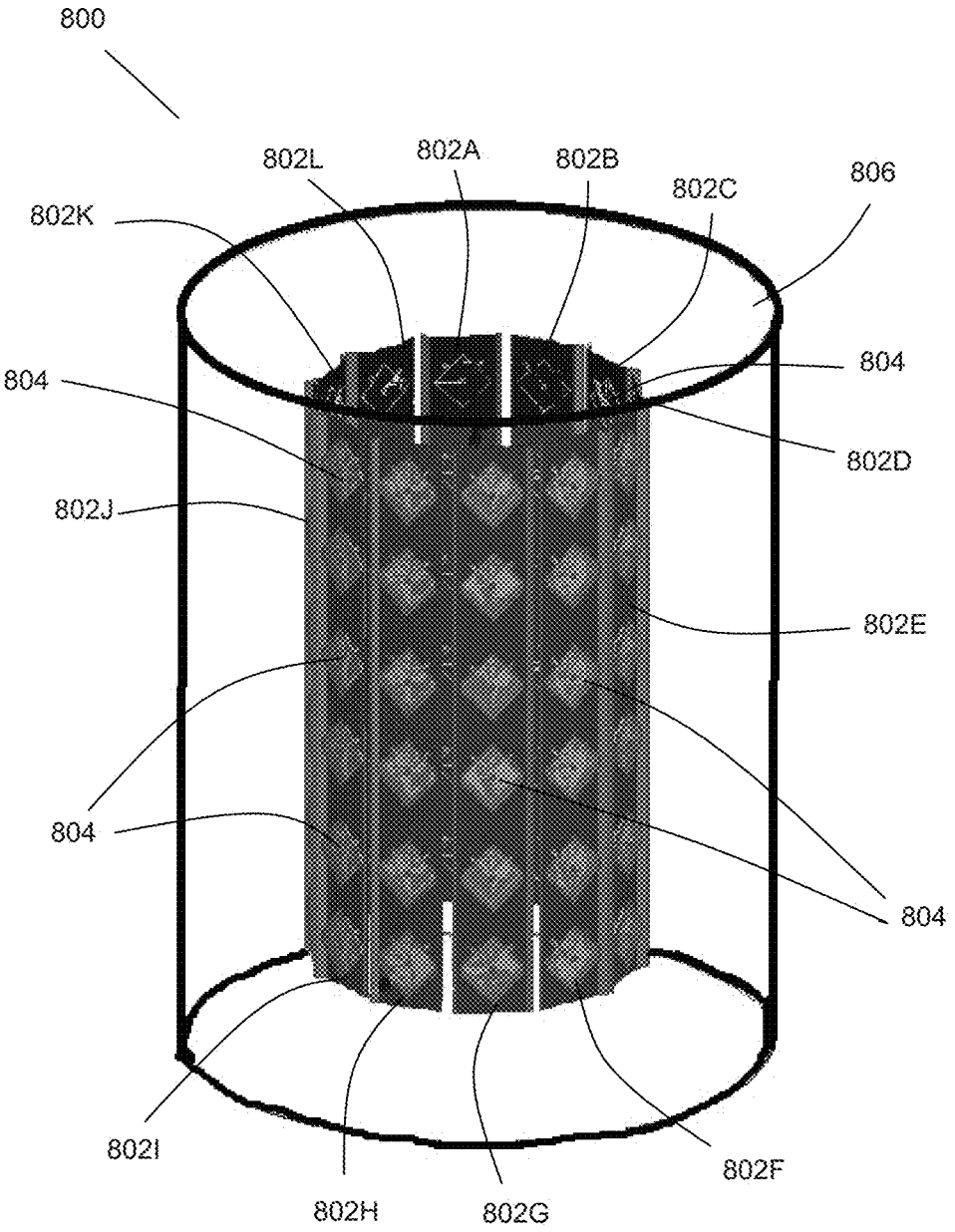
FIG. 8 is a perspective view of an 8×8 MIMO omnidirectional antenna of the present invention.

Referring now to FIG. 8, there is provided an 8×8 MIMO omnidirectional antenna indicated generally by reference numeral 800. The 8×8 MIMO omnidirectional antenna 800 comprises a twelve antenna columns 802A, 802B, 802C, 802D, 802E, 802F, 802G, 802H, 802I, 802J, 802K, 802L arranged in a substantially dodecagonal arrangement such that the transverse cross-section of the antenna columns 802A-802L in the 8×8 MIMO omnidirectional antenna 800 will be substantially dodecagonal in shape. Each of the twelve antenna columns 802A, 802B, 802C, 802D, 802E, 802F, 802G, 802H, 802I, 802J, 802K, 802L is substantially rectangular in shape such as to comprise side edges, a top edge, and a bottom edge, whereby the side edges are longer than the top edge and the bottom edge respectively, as in the previous 4×4 MIMO omnidirectional antenna embodiment.

The twelve antenna columns 802A-802L are each positioned adjacent to two of the remaining antenna columns along their side edges, such that the twelve antenna columns 802A-802L are arranged to have a substantially dodecagonal transverse cross-section. It is again important to arrange the twelve antenna columns 802A-802L in as tight a pattern as possible, for creating the smallest form factor possible, and also for improvements in the radiation pattern. It is not desirous to separate the twelve antenna columns 802A-802L away from one another and thus it is an aspect of the present invention that each of the twelve antenna columns 802A-802L are in abutment, along their side edges, with their two adjacent antenna columns 802A-802L. This encourages the transverse cross-sectional diameter of the 8×8 MIMO omnidirectional antenna 800 to be as small as possible. Each of the twelve antenna columns 802A-802L has a plurality of radiators 804 mounted thereto. In a preferred embodiment as shown in FIG. 8, there are six radiators 804 mounted on each of the twelve antenna columns 802A-802L. The radiators 804 are mounted in a substantially vertical manner and in a linear fashion along the length of the rectangular-shaped antenna columns 802A-802L. These radiators 804 are preferably dual polarised antenna elements which can radiate two signals at the same time by virtue of their dual polarisation. A radome 806 encases the radiators 804 and the antenna columns 802A-802L. The relatively small diameter and height of the radome 806 is an important aspect of the present design as this will minimise the overall size of the antenna 800 and make it less of an eyesore when deployed in public spaces.

As a 8×8 MIMO omnidirectional antenna 800 will have eight ports (not shown) to receive eight signals to be sent using the 8×8 MIMO omnidirectional antenna 800, the signals on these eight ports shall be connected to the radiators of the antenna columns 802A-802L. In a preferred embodiment, a first pair of the eight ports is connected to a first group of three of the twelve antenna columns 802A-802L. A second pair of the eight ports is connected to a second group of three of the twelve antenna columns 802A-802L. A third pair of the eight ports is connected to a third group of three of the twelve antenna columns 802A-802L. And, a fourth and final pair of the eight ports is connected to a fourth group of three of the twelve antenna columns 802A-802L. The antenna columns 802A-802L are configured such that one of the antenna columns (e.g. 802A) in the first group is situated adjacent one of the antenna columns (e.g. 802B) in the second group; with said antenna column (e.g. 802B) in the second group being situated adjacent one of the antenna columns (e.g. 802C) in the third group; and said antenna column (e.g. 802C) in the third group being situated adjacent one of the antenna columns (e.g. 802D) in the fourth group. In this manner, one antenna column from each of the groups is arranged side-by-side into a column set comprising four antenna columns. There are three such column sets, and the three column sets are arranged in the dodecagonal shape of the 8×8 MIMO omnidirectional antenna 800 so as to be centrosymmetric about the centre point of the antenna, and to be axisymmetric about the radially-directed axis. Three columns sets, with each column set comprising four antenna columns and each column set receiving all of the eight input signals, are this established. The arrangement of the three column sets formed by the groups of antenna columns 802*a*/802B/802C/803D, 802E/802F/802G/802H, 802I/802J/802K/802L is centrosymmetric about a central point of the 8×8 MIMO omnidirectional antenna 800, and each antenna column 802A-802L is axisymmetric about a radially-directed axis which extends between the centre point of the 8×8 MIMO omnidirectional antenna 800 and a transverse cross-sectional midpoint on the antenna column 802A-802L. The radiation pattern established by each of the three or more column sets is thus centrosymmetric about the centre point of the 8×8 MIMO omnidirectional antenna 800, and, is also axisymmetric about the radially-directed axis.

References to antenna components being centrosymmetric in the preceding specification will be understood to refer to the antenna components being symmetric about a central point/region when the transverse cross-sectional view of the antenna and antenna components is observed. References to antenna components being axisymmetric in the preceding specification will be understood to refer to the antenna components being symmetric about a certain axis.

The terms "comprise" and "include", and any variations thereof required for grammatical reasons, are to be considered as interchangeable and accorded the widest possible interpretation.

It will be understood that the components shown in any of the drawings are not necessarily drawn to scale, and, like parts shown in several drawings are designated the same reference numerals.

The terms "antenna" and "antenna array" shall be understood to refer to the same apparatus and have been used interchangeably in the preceding specification.

It will be further understood that features from any of the embodiments may be combined with alternative described embodiments, even if such a combination is not explicitly recited hereinbefore but would be understood to be technically feasible by the person skilled in the art.

The invention is not limited to the embodiments hereinbefore described which may be varied in both construction and detail.

What is claimed is:

1. A Multiple-Input Multiple-Output (MIMO) omnidirectional antenna comprising three or more column sets, where the three or more column sets are arranged in a centrosymmetric arrangement about a centre point of the antenna;

each column set comprising two or more antenna columns and each of the antenna columns mounting a plurality of radiators thereon;

whereby, each antenna column receives no more than two signals to be transmitted, and, each of the antenna columns is arranged to be axisymmetric about a radially-directed axis which extends between the centre point of the antenna and a transverse cross-sectional midpoint on the antenna column;

such that, each radiation pattern established by each of the three or more column sets is centrosymmetric about the centre point of the antenna, and, is axisymmetric about the radially-directed axis.

2. The Multiple-Input Multiple-Output omnidirectional antenna as claimed in claim 1, wherein the Multiple-Input Multiple-Output omnidirectional antenna is a 4×4 Multiple-Input Multiple-Output antenna comprising six antenna columns arranged in a hexagonal arrangement.

3. The Multiple-Input Multiple-Output omnidirectional antenna as claimed in claim 1, wherein the Multiple-Input Multiple-Output omnidirectional antenna is a 8×8 Multiple-Input Multiple-Output antenna comprising twelve antenna columns arranged in a dodecagonal arrangement.

4. The Multiple-Input Multiple-Output omnidirectional antenna as claimed in claim 1, wherein, each radiation pattern established by each of the three or more column sets is both centrosymmetric and axisymmetric for both amplitude and phase.

5. The Multiple-Input Multiple-Output omnidirectional antenna as claimed in claim 2, wherein, each radiation pattern established by each of the three or more column sets is both centrosymmetric and axisymmetric for both amplitude and phase.

6. The Multiple-Input Multiple-Output omnidirectional antenna as claimed in claim 3, wherein, each radiation pattern established by each of the three or more column sets is both centrosymmetric and axisymmetric for both amplitude and phase.

7. The Multiple-Input Multiple-Output omnidirectional antenna as claimed in claim 1, wherein the Multiple-Input Multiple-Output omnidirectional antenna comprises three column sets.

8. The Multiple-Input Multiple-Output omnidirectional antenna as claimed in claim 1, wherein the Multiple-Input Multiple-Output omnidirectional antenna comprises six column sets.

9. The Multiple-Input Multiple-Output omnidirectional antenna as claimed in claim 2, wherein the 4×4 Multiple-Input Multiple-Output omnidirectional antenna comprising a plurality of radiators mounted on six antenna columns, with each of the six antenna columns mounting a plurality of radiators;

each of the six antenna columns being substantially rectangular in shape such as to comprise side edges, a top edge and a bottom edge whereby the side edges are longer than the top and bottom edges;

each of the six antenna columns being positioned adjacent to two of the remaining antenna columns along its side edges, such that the six antenna columns are arranged to have a substantially hexagonal transverse cross-section;

wherein, the 4×4 Multiple-Input Multiple-Output omnidirectional antenna comprises four antenna ports for receiving four signals to be transmitted;

two of the four ports being connected to three of the six antenna columns and the other two ports being connected to the other three antenna columns;

whereby, the antenna columns are configured such that an antenna column connected to two of the antenna ports is situated intermediate two adjacent antenna columns connected to the other two ports.

10. The Multiple-Input Multiple-Output omnidirectional antenna as claimed in claim 3, wherein the 8×8 Multiple-Input Multiple-Output omnidirectional antenna comprising a plurality of radiators mounted on twelve antenna columns, with each of the twelve antenna columns mounting a plurality of radiators;

each of the twelve antenna columns being substantially rectangular in shape such as to comprise side edges, a top edge and a bottom edge whereby the side edges are longer than the top and bottom edges;

each of the twelve antenna columns being positioned adjacent to two of the remaining antenna columns along its side edges, such that the twelve antenna columns are arranged to have a substantially dodecagonal transverse cross-section;

wherein, the 8×8 Multiple-Input Multiple-Output omnidirectional antenna comprises eight antenna ports for receiving eight signals to be transmitted;

a first pair of the eight ports being connected to a first group of three of the twelve antenna columns;

a second pair of the eight ports being connected to a second group of three of the twelve antenna columns;

a third pair of the eight ports being connected to a third group of three of the twelve antenna columns; and a fourth pair of the eight ports being connected to a fourth group of three of the twelve antenna columns;

whereby, the antenna columns are configured such that one of the antenna columns in the first group is situated adjacent one of the antenna columns in the second group; with said antenna column in the second group being situated adjacent one of the antenna columns in the third group; and said antenna column in the third group being situated adjacent one of the antenna columns in the fourth group.

11. The Multiple-Input Multiple-Output omnidirectional antenna as claimed in claim 9, wherein, each of the antenna columns comprises four radiators.

12. The Multiple-Input Multiple-Output omnidirectional antenna as claimed in claim 10, wherein, each of the antenna columns comprises six radiators.

13. The Multiple-Input Multiple-Output omnidirectional antenna as claimed in claim 1, wherein, each of the antenna columns is substantially rectangular in shape such as to comprise side edges, a top edge and a bottom edge whereby the side edges are longer than the top and bottom edges.

14. The Multiple-Input Multiple-Output omnidirectional antenna as claimed in claim 13, wherein, the radiators are mounted substantially vertically in a linear fashion along the length of the rectangular-shaped antenna columns.

15. The Multiple-Input Multiple-Output omnidirectional antenna as claimed in claim 1, wherein, the radiators are dual polarised antenna elements.

16. The Multiple-Input Multiple-Output omnidirectional antenna as claimed in claim 14, wherein, the radiators are dual polarised antenna elements.

17. The Multiple-Input Multiple-Output omnidirectional antenna as claimed in claim 1, wherein, none of the plurality of radiators are phase shifted.

18. The Multiple-Input Multiple-Output omnidirectional antenna as claimed in claim 9, wherein, the 4×4 Multiple-Input Multiple-Output omnidirectional antenna operates as a dual band 2×2 Multiple-Input Multiple-Output omnidirectional antenna.

19. The Multiple-Input Multiple-Output omnidirectional antenna as claimed in claim 1, wherein, the Multiple-Input Multiple-Output omnidirectional antenna is housed within a tubular shaped radome.

20. The Multiple-Input Multiple-Output omnidirectional antenna as claimed in claim 9, wherein, the 4×4 Multiple-Input Multiple-Output omnidirectional antenna is housed within a tubular shaped radome.

* * * * *